US005329265A

United States Patent [19]

Guidi et al.

[11] Patent Number: 5,329,265

[45] Date of Patent: Jul. 12, 1994

[54] INTERMEDIATE SUPPORT RELAY FOR USE PARTICULARLY IN MOTOR VEHICLES

[75] Inventors: Guido Guidi, Frosinone; Alberto Petrone, Collegno, both of Italy

[73] Assignee: Bitron "A" S.p.A., Cantalupa, Italy

[21] Appl. No.: 40,489

[22] Filed: Mar. 31, 1993

[30] Foreign Application Priority Data

May 20, 1992 [IT] Italy ..... TO 92 A 000434

[51] Int. Cl.[5] ..... H01H 51/22

[52] U.S. Cl. ..... 335/78; 335/80; 335/86

[58] Field of Search ..... 335/78-86, 335/124, 129, 202

[56] References Cited

U.S. PATENT DOCUMENTS 5,151,675 9/1972 Bichl et al. .

FOREIGN PATENT DOCUMENTS 0326116 1/1989 European Pat. Off. .

0484592 11/1990 European Pat. Off. .

*Primary Examiner*—Lincoln Donovan

*Attorney, Agent, or Firm*—Herbert Dubno

[57] ABSTRACT

A relay for use particularly in motor vehicles has a stable ferromagnetic core, an excitation coil wound around the core, a movable assembly composed of at least one movable ferromagnetic armature, a flexible foil or leaf spring fixed at a determined point of the movable armature and a contact. The relay also includes a return spring to maintain a maximum air gap for the armature with respect to the core when the device is in a release condition. At least one closure and/or opening contact is activated by the movable armature, through its contact when it is drawn or released by the core. An intermediate support element for the flexible foil is provided on one of the elements of the movable assembly.

4 Claims, 11 Drawing Sheets

INTERMEDIATE SUPPORT RELAY FOR USE PARTICULARLY IN MOTOR VEHICLES

FIELD OF THE INVENTION

The present invention relates to a relay for use particularly in motor vehicles, comprising a stable ferromagnetic core, an excitation coil wound around the core, a movable assembly composed of at least one movable ferromagnetic armature, a flexible foil fixed at a predetermined point of said movable armature and an exchange contact. The relay also includes a return spring to maintain a maximum air gap of the armature with respect to the core when the device is in a release condition and at least one closure and/or opening contact that is activated by the movable armature, through its exchange contact, when the latter is drawn or released by the core.

BACKGROUND OF THE INVENTION

Relays of the type described are known.

Such relays have the drawback that, particularly in certain applications, such as in charging capacitors, the wear of the contacts is relatively high, which causes the useful life of the relay to be relatively short; the problem is increased by the mechanical working tolerances that determine a spread of the pressure characteristics with which the contacts become closed. Another drawback concerns the way with which the flexible foil is joined with the movable armature. The attachment is normally made through riveting, that creates only one binding point. This generates an imperfect joint that produces inconstancies on the real value of geometry in play.

OBJECT OF THE INVENTION

The object of the present invention is to eliminate the drawbacks of the prior art and, in particular, to provide an improved relay that has less wear of the contacts than traditional relays and therefore a longer useful life.

SUMMARY OF THE INVENTION

These objects are achieved by the invention in a relay for use particularly in motor vehicle, comprising a stable ferromagnetic core, an excitation coil wound around the core, a movable assembly constituted of at least one movable ferromagnetic armature, a flexible foil or leaf spring fixed at a determined point of said movable armature and an exchange contact, the relay also includes a return spring to bias the armature into a position of maximum air gap between the armature and the core when the device is in a release condition and at least one closure and/or opening contact that is activated by the movable armature, through its exchange contact when this is drawn or released by the core. According to the invention, the relay has an intermediate support element for said flexible foil on one of the elements of the movable assembly.

BRIEF DESCRIPTION OF THE DRAWINGS

The above and other objects, features, and advantages will become more readily apparent from the following description, reference being made to the accompanying drawing in which:

FIG. 7A is a graph which schematically represents the flow of the current in the case in which the charge for the relay is represented by a halogen lamp, while

SPECIFIC DESCRIPTION

Normally relays of the type described in the following description are used in motor vehicles.

All such relays have substantially a structure having a ferromagnetic core, an excitation coil and at least one movable armature.

Figure 1:
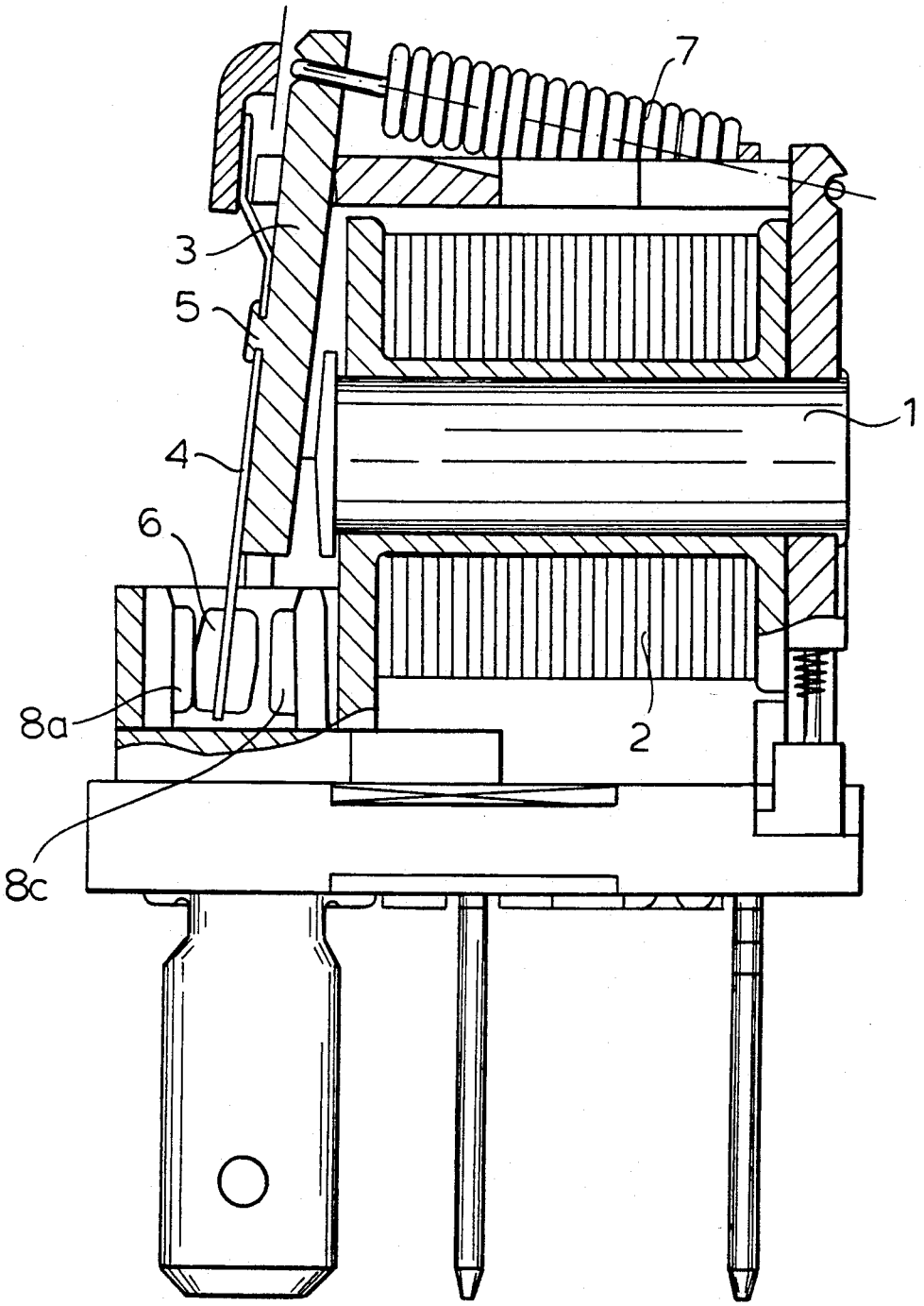
FIG.1 PRIOR ART
FIG 1 is a cross sectional view through a relay of the prior art.

In FIG. 1 a traditional relay of the type used in motor vehicles is schematically represented.

A stable ferromagnetic core has an excitation coil 2 wound around the core. A movable ferromagnetic armature 3 is juxtaposed with the core and carries a leaf spring or flexible foil, for example of an approximately triangular form, fixed at a determined point 5 of the movable armature. The leaf spring or foil 4 is provided with an electric exchange contacts; the return spring 7 biases the armature 3 in a direction in maintaining maximum air gap with respect to the core when the device is in a rest condition. Finally the cooperates with an electric opening contact 8*a* and an electric closure contact 8*c* that are activated by the movable armature 3, through its exchange contact 6, when this is respectively released or drawn by the core 1.

In such devices the relay operates by the interaction between a force that is created by the excitation of a variable reluctance magnetic circuit and the corresponding reaction of the mechanical system; the task of such force is to attract the movable armature towards the core of the device.

Figure 2:
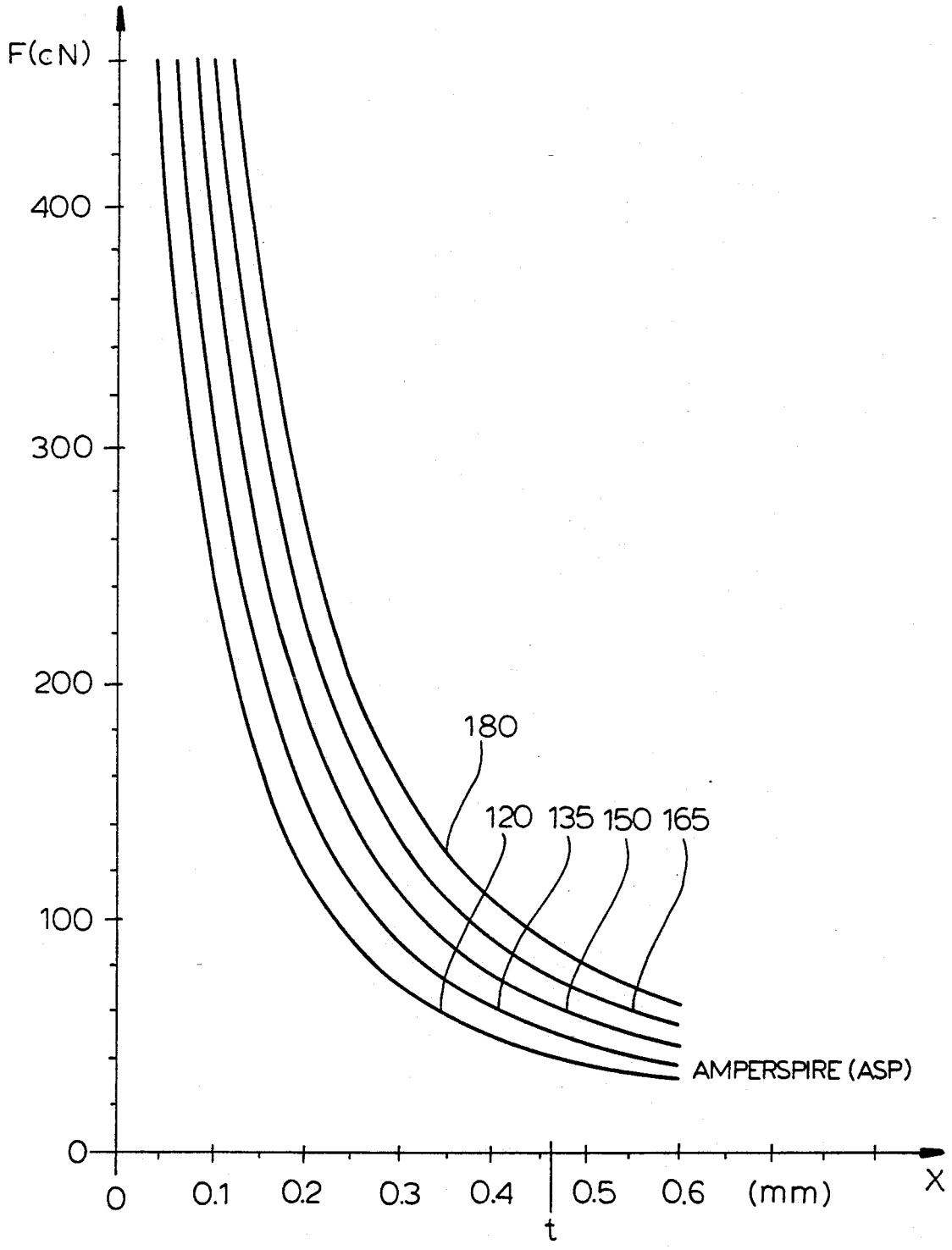
FIG. 2 is a family of curves plotting forces of attraction/air gap at constant magnetomotive force, relative to relays within geometric characteristics of the type being the invention.

For this purpose an electromagnetic attraction force is generated, which is represented by an expression of the type:

$$F=k_1 I^2/(k_2+x)^2$$

where I is the excitation current of the magnetic circuit which is assured to be constant, $k_1$ and $k_2$ are constant that express geometric and magnetic parameters of the device, x is the variable of the air gap valued in reference to the axis of the excitation bobbin. The above mentioned formula forms, on a Cartesian plane, of the perbolas family, to each of which corresponds a current value, as represented in FIG. 2.

The significant part of such curves is obviously that which goes from an air gap being equal to zero (x=0) to an air gap being equal to the maximum value t, (x=t).

Figure 3:
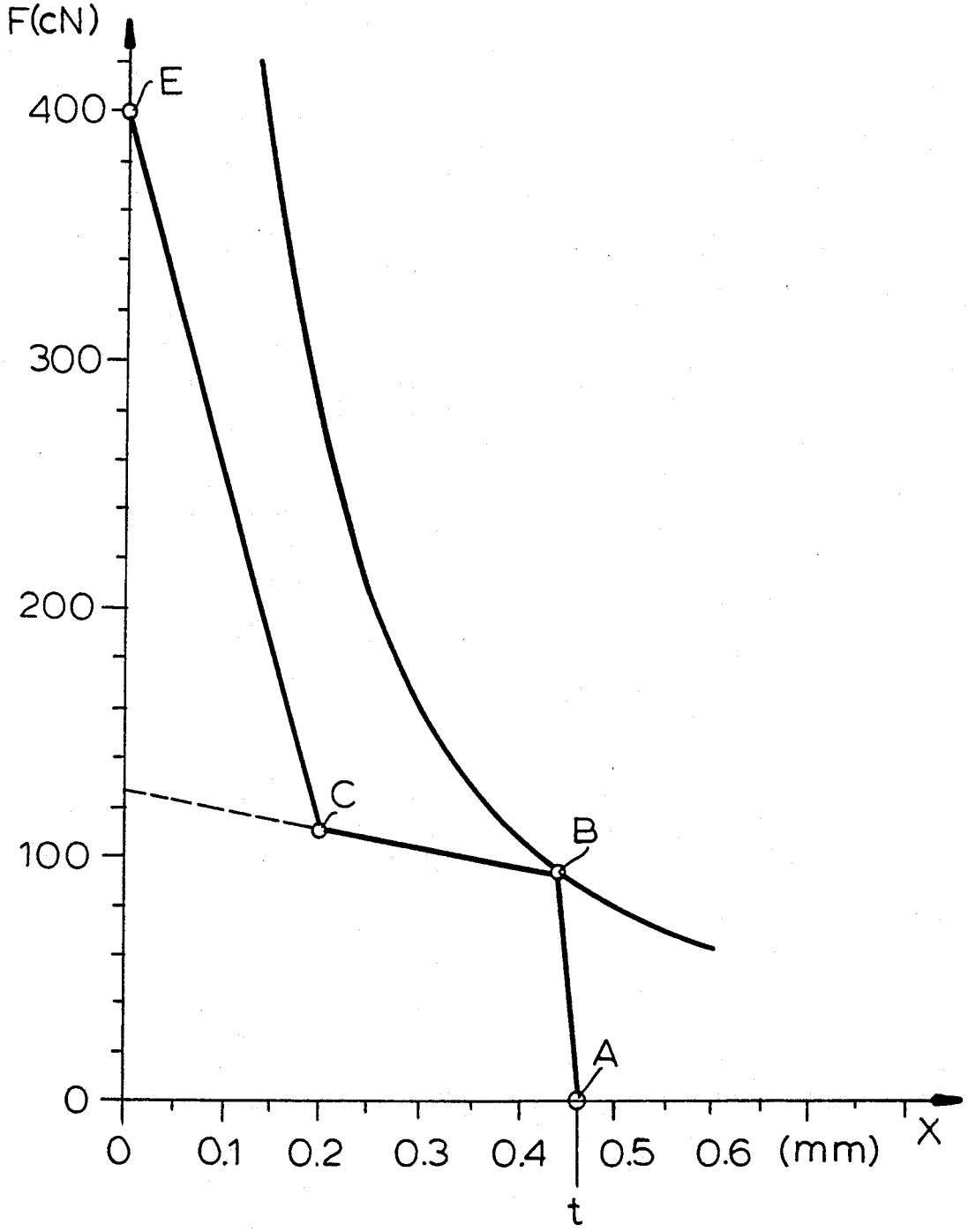
FIG. 3 is a graph which contains one of the curves of FIG. 2 and a segmented line that schematically represents the reaction movement of the mechanical system (proportional to the forces on the contacts) depending on the movement carried out under the action of the electromagnetic force of the relay in FIG. 1, detected on the axis of the bobbin.

The corresponding reaction of the mechanical system can be represented, for traditional relays, on the same previously indicated Cartesian plane, with a segmented line formed from three segments, as represented in FIG. 3. The corresponding reaction of the mechanical system is the result of the combination of the return force of the spring 7 and of the deformation force of the foil 4 that varies depending on the position of the movable assembly as will be clearly seen below.

The segmented line, represented in FIG. 3, is the simple result of the analysis of an extremely simple mechanical model, formed by a movable assembly hinged to an extremity, subjected in the central part to the action of a force and stopped in movement by the appropriately positioned support points.

Figure 4:
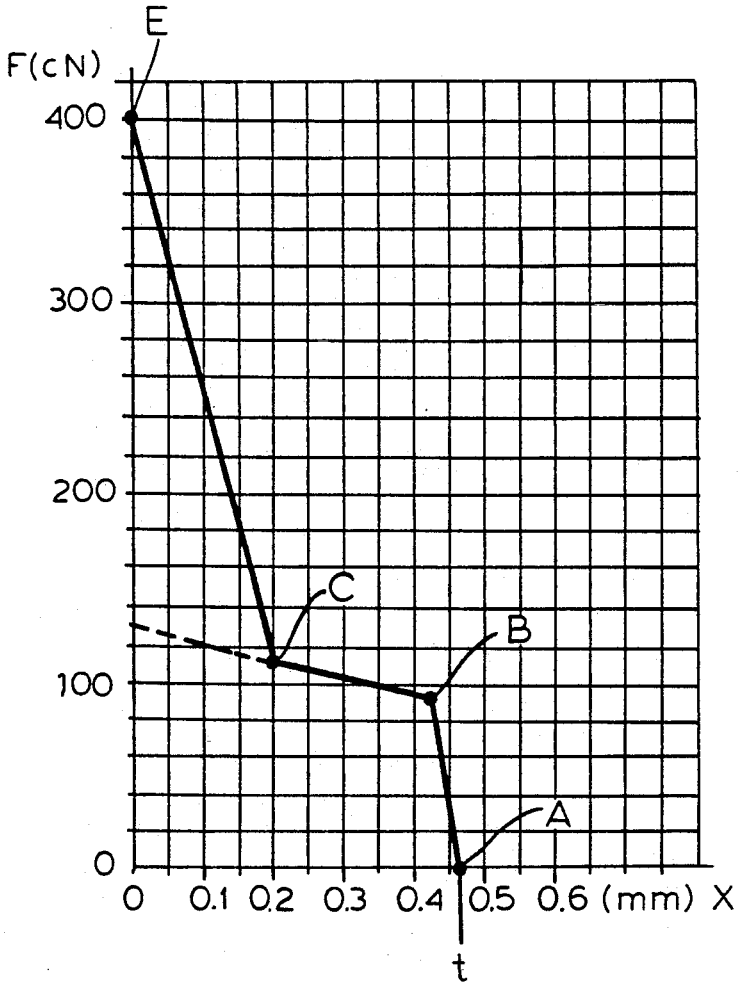
FIG. 4 PRIOR ART
FIG. 4 is a graph and FIGS. 4A, 4B, 4C, and 4E are cross sectional views which the movable assembly with reference to the segmented line of FIG. 3.
Figure 4A:
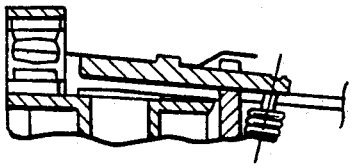
FIG.4A PRIOR ART

In such model in absence of the attraction force (rest condition) there is the maximum closure force on contact 8*a*, due to the action of the return spring 7 in equilibrium with the reaction due to the elastic deformation of a small portion of foil 4. Point A (FIG. 4) of the segment A-B (see FIG. 4A).

Figure 4B:
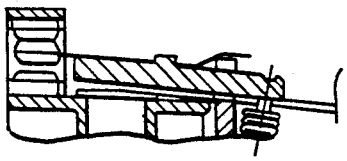
FIG. 4B PRIOR ART

Subjecting the movable armature to the attraction force, that will be indicated with FB (necessary force for reaching point B of the graph of FIG. 4), the elastic deformation of the foil is cancelled and with a minimum air gap reduction the sole reaction of the return spring is balanced. Point B of the segment A-B (see FIG. 4B).

Figure 4C:
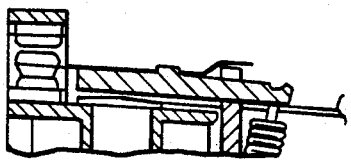
FIG.4C PRIOR ART

Increasing the attraction force to a value FC (necessary force for reaching point C of the graphic of FIG. 4), the air gap is reduced due to the effect of the rotation of the movable armature on the hinge with minimum force increments due to the characteristic of the return spring, while the exchange contact 6 passes from the contact position with the stable contact 8*a* to the contact position with the stable contact 8*c*. Point C of the segment B-C (see FIG. 4C). At this moment the exchange contact 6 of the flexion foil rests on the contact 8*c* with an initially zero force, (point C). In such a situation the movable armature is separated from the additional movement.

Figure 4E:
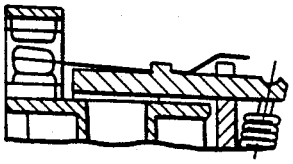
FIG.4E PRIOR ART

Increasing furthermore the acting force up to a value FE (necessary force for reaching point E of the graph of FIG. 4), the segment C-E is covered, to which strong force increments correspond, due to the reaction of elastic deformation of the foil 4 that at point E reach their maximum value, when the movable armature 3 comes to rest on the core 1, as shown in FIG. 4E.

The elastic deformation of the foil 4 during the additional movement determines the closure force of the contacts and as a result determines their capacity in supplying current. At point E the armature has carried-out its complete movement and the foil is retracted with respect to the former, after having rested on the contact 8*c*.

Until the complete closure of the contacts of the device is reached, it is evident that the minimum current admissible for a given relay is that for which the curve of the attraction force remains above the segmented line curve of the mechanical reaction of the actual relay as indicated in FIG. 3, that represents the hyperbola limit.

According to invention the movable armature 3 is furnished, at its extremity, with a relief 9 (FIG. 5), obtained by indenting the armature; due to the effect of the bump a relief 9, the foil 4 is furnished with an intermediate point of support appropriately positioned approximately midway of its length. Such relief 9 will be advantageously positioned, if compared to the work length of the foil 4, or appropriately dimensioned concerning the height, in a such a way to confer to the gradient of the exercised force on the contact, immediately after its closure, a suitable value according to the type of use of the relay. Furthermore the foil 4 is fixed, through a small fixation plate 5, that transversely extends to the foil 4 for all its width thus realizing a perfect joint condition.

In a preferred form of realization a hole 10 is provided in the flexible foil 4 so as to allow access to the movable armature of a measuring element of the functional characteristics.

Figure 5:
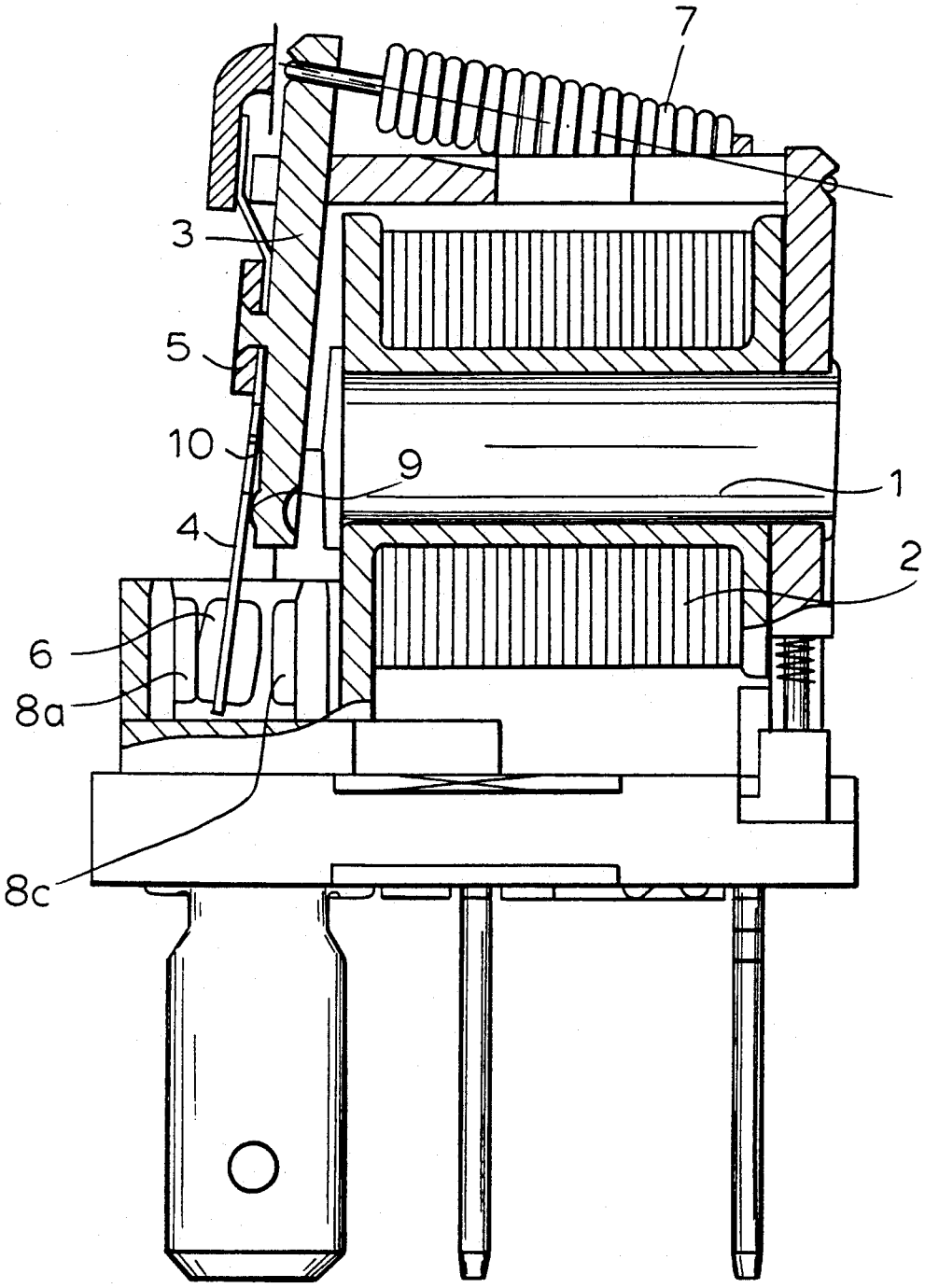
FIG. 5 is a cross sectional view which schematically represents a relay according to invention.
Figure 6:
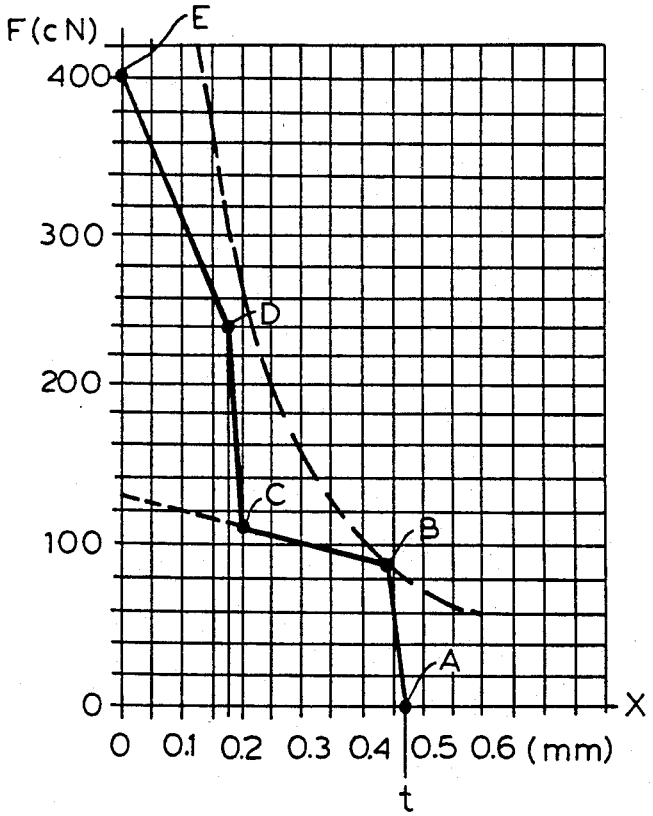
FIG. 6 is a graph and FIGS. 6C, 6D, and 6E are cross sectional views which show in the case of the relay of FIG. 5, the segmented line equivalent to that of FIG. 4 and the positions C, D and E of the movable assembly with reference to the segmented line of FIG. 3.
Figure 6C:
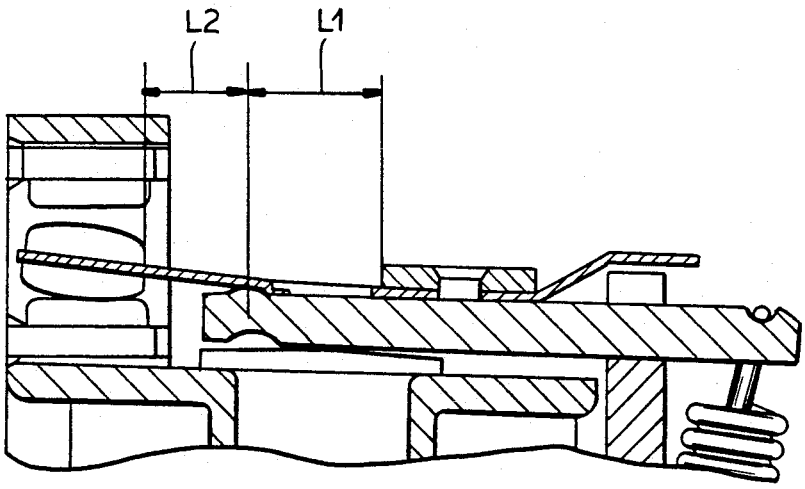
Figure 6D:
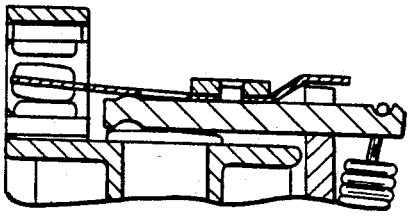

Up to point C of the graph in FIG. 6, the behavior of the relay of known type of FIG. 1 and of the new relay of FIG. 5 are similar.

Figure 6E:
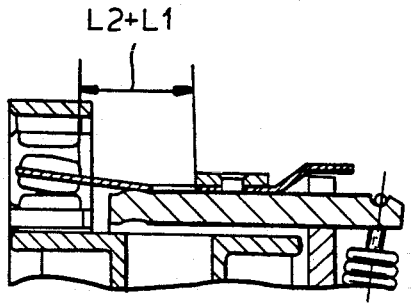

During a first phase of the additional movement in which the foil 4 is not yet detached from the point of support 9 the elastic deformation of the foil is limited only to the section L2 (see FIG. 6, point D); in the second phase of the additional movement, after the detachment of the foil from the point of support 9, the elastic deformation occurs along the whole length of the foil L1+L2 (FIG. 6E) so that a four segment diagram of stress is obtained (see FIG. 6 ).

The third segment (C-D) is of a relatively high slope (due to the reduced flexion length L2), while the fourth segment (D-E) is of a minor slope (due to flexion length L1+L2).

The relay according to the invention has the following advantages if compared to traditional relays:

In every productive process the manufacturing tolerances that determine maximum and minimum admissible values exist; the most influencing variable is the mechanical tolerance on the additional movement that determines two segment lines of limit forces, inside of which all the segment lines of force relative to produced devices are found; in particular for the lower force segment lines the verified situation in the case of foil with intermediate support is significantly more favorable than in the case of conventional foil. See the comparison in FIGS. 8A and 8B wherein FIG. 8A the situation of the tolerances for a relay of known type is represented, while in FIG. 8B the behavior of the tolerances for a relay according to invention is represented. Both the representations of the procedures have been indicated with dot/dash lines for the minimum values of the tolerances, while with broken lines for indicating the maximum values of the tolerances. The results of the two FIGS. have been given with parity of conditions.

Figure 8B:
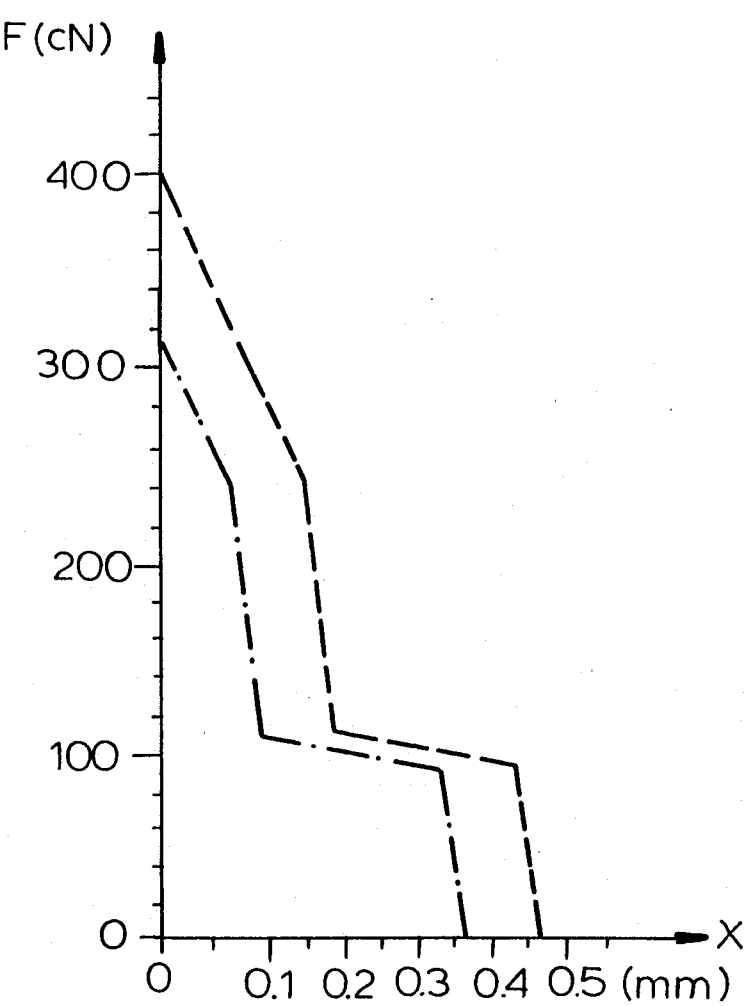
FIGS. 8A and 8B are graphs which schematically represent the movement of the reaction force of the mechanical system and of the magnetomotive force, both for the relay of FIG. 1 and for the relay of FIG. 5, taking into consideration the relative manufacturing tolerances.
Figure 8A:
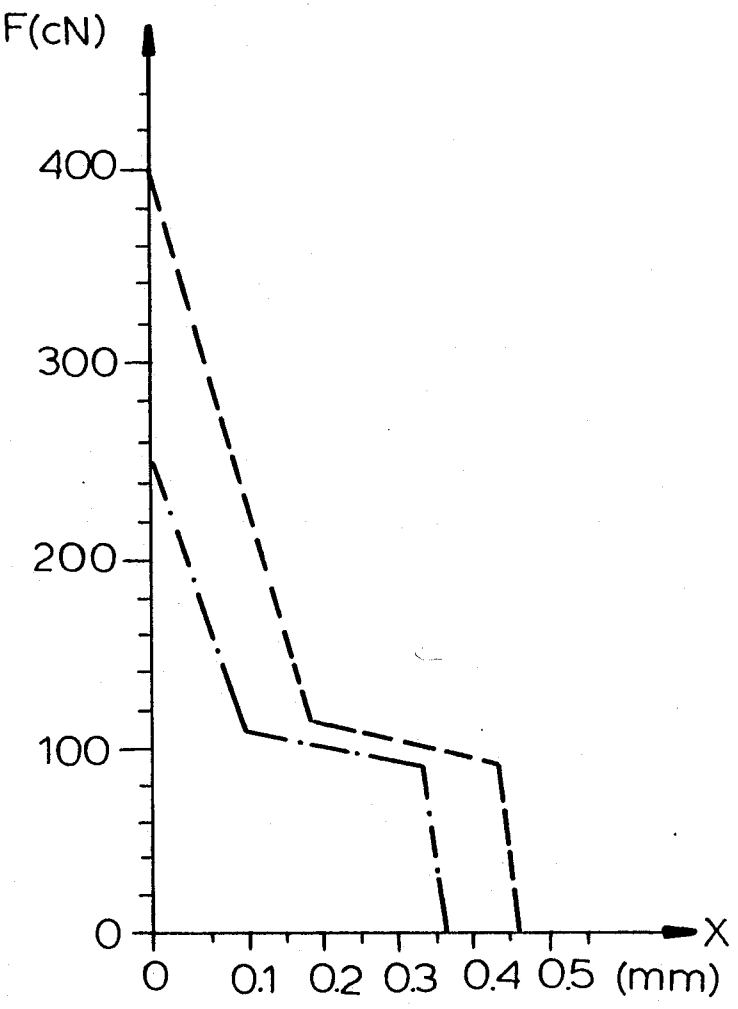
FIG.8A PRIOR ART

The substantial advantage of the relay according to invention resides in the fact that point E that indicates the closure force of the contacts is in FIG. 8B significantly greater than in FIG. 8A.

The realization of a perfect joint condition of the flexible foil with the movable armature assures reproducible fixation conditions with a constant functional guaranty.

Figure 9:
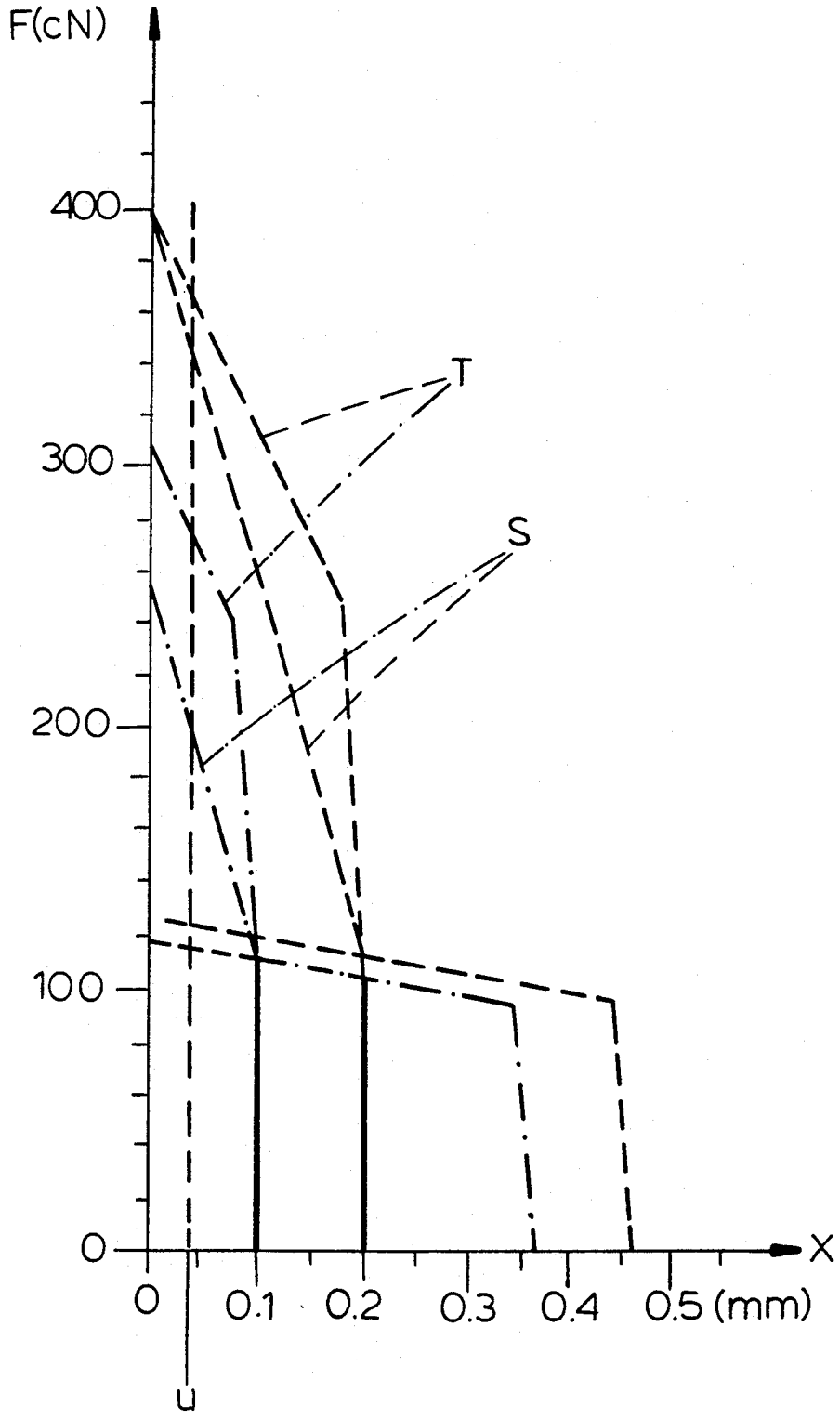
FIG. 9 is a graph which indicates the overlapped situations that are verified in the relays of FIG. 1 and FIG. 5 due to wear.

The wear of the closure contacts of the relay, brings about a reduction of the additional movement, and therefore in the diagram of the forces to a displacement of the origin of the axis towards the right; it can be noted how the relay with intermediate support determines in the whole field of the tolerances a greater closure force; the maximum benefit is produced in the field where the tolerances are of major influence, as demonstrated in the comparison in FIG. 9 where the segmented line of 4 segments refers to the relay according to the invention, while the segmented line of 3 segments refers to a relay of the known type. In FIG. 9 the vertical dotted line U represents the position assumed by the axis of the ordinates in a wear condition of the contacts.

Figure 7A:
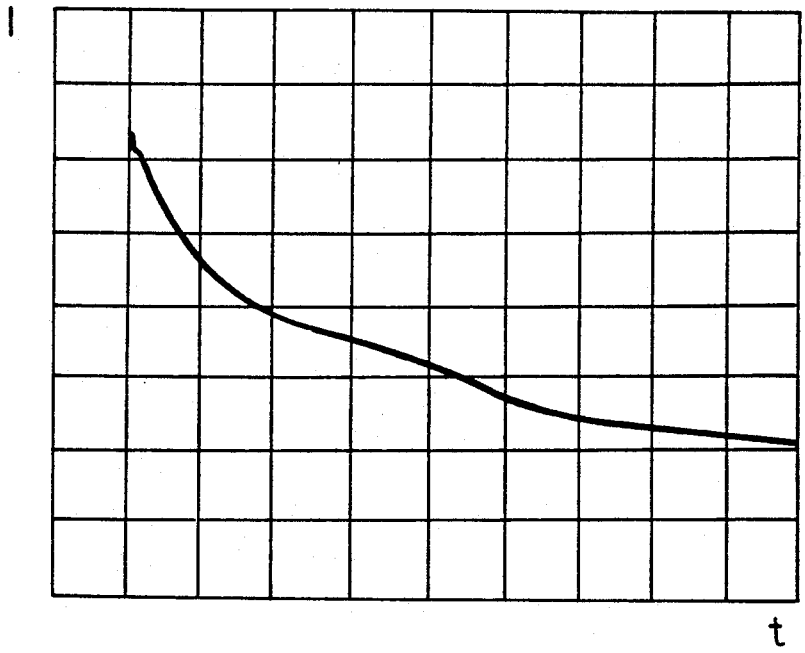
Figure 7B:
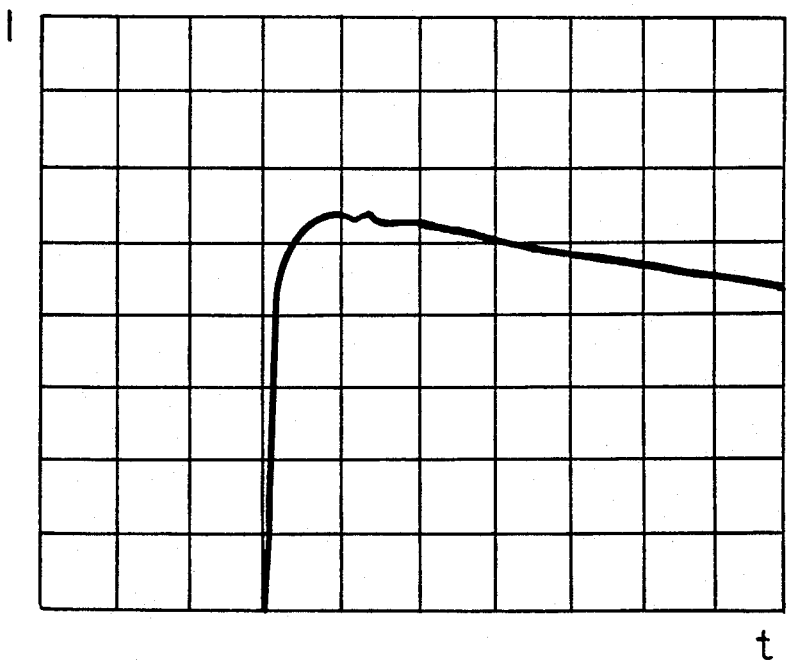
FIG. 7B is a graph which represents in an enlarged scale the peak of the initial current of FIG. 7A.
Figure 10:
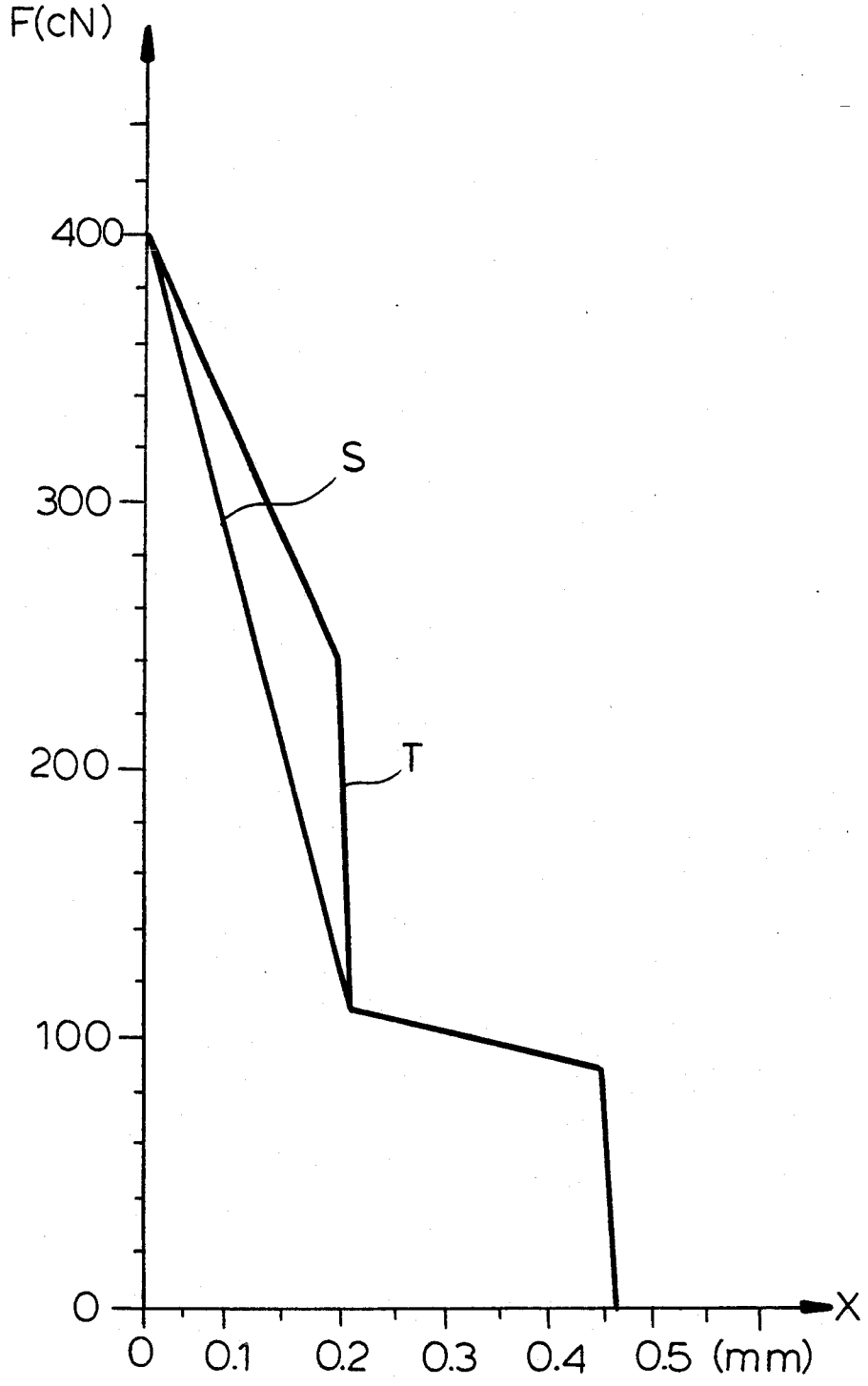
FIG. 10 is a graph which indicates schematically the difference between the forces in the relays of FIG. 1 and FIG. 5 in the part of additional movement.

As already mentioned, the current that two contacts are able to commute without drawbacks is directly proportional to the force with which they are maintained closed; in the case of so-called capacitive currents, having a curve similar to the charge current of a capacitor (note for example FIGS. 7A and 7B), a closure force is required that immediately manifests high values; it can be noted from FIG. 10 that the segmented line T of four segments of the relay according to the invention manifests in the first section of the additional movement force increments which are much greater than those of the S shape of three segments of a traditional relay. This determines a closure of the contacts with sufficient force to commute currents of a powerful initial start, which is obtained in the closure on very low initial resistance charges.

Figure 11A:
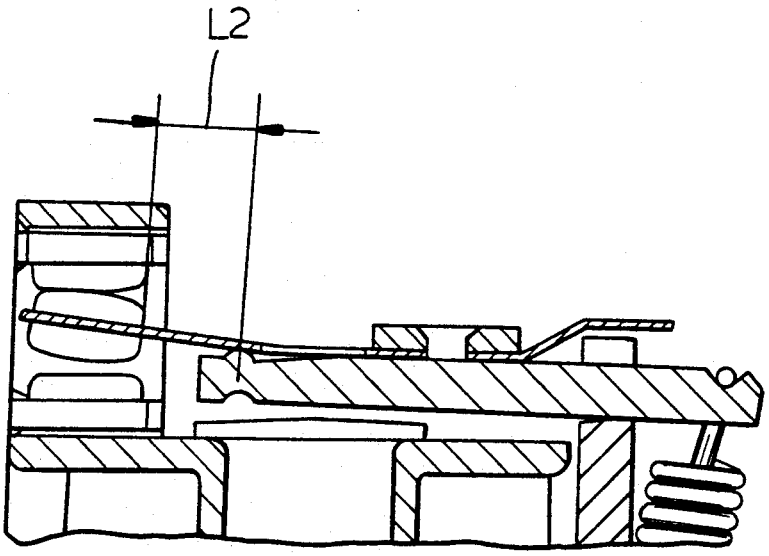
FIGS. 11A and 11B are cross sectional views which schematically indicate the difference of the free flexion length of the foil having contact in the return to the stable position, between a relay of the type shown in FIG. 1 and one of the type shown in FIG. 5.
Figure 11B:
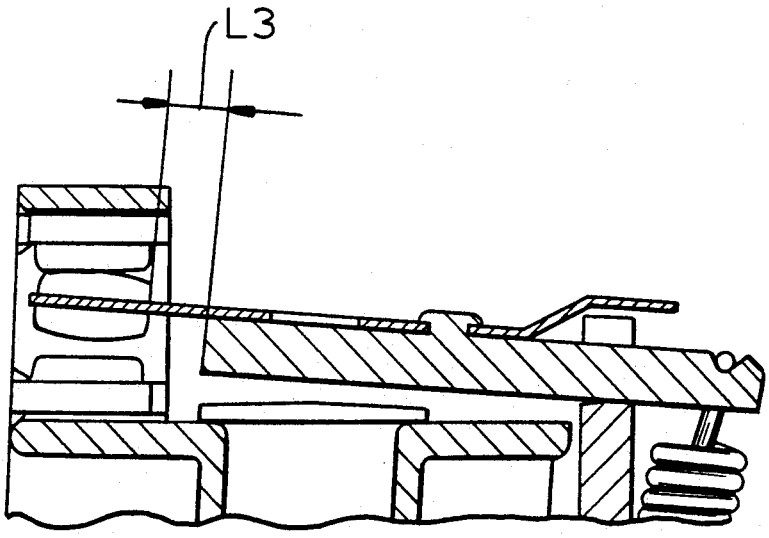
FIG.11B PRIOR ART

One of the fundamental variants that determine the life of a relay, is the speed with which the transitions are accomplished, i.e. the time between the beginning and the end of a maneuver; experimentally it has been proved that, under a parity of conditions, with relays with intermediate support, lower duration is always obtained or transitions of equal duration with lower excitation voltages. For the same reasons one can note experimentally the same benefits, united to a lower number of bounces, in passing from one contact to another during the deviation maneuver, mainly in the return to the stable equilibrium position for the greater length of flexion (L2) with which the foil of the relay of FIG. 5 absorbs the impact energy as demonstrated in FIGS. 11A and 11B. In fact in traditional relays the flexion length in the opening position L3 is minor, with consequent minor capacity to absorb the bounces.

From the description the advantages of the present invention become clear. Of course numerous variants are possible to the relay object of the present invention.

For example the relief 9 that realizes the intermediate support could be obtained on the foil 4 rather than on the armature 3.

Other variants could be realized by replacing the constructive elements shown in the figures with simple technical equivalents.

We claim:

1. A relay, particularly for use in an automotive vehicle, comprising:
   - a stable ferromagnetic core;
   - an excitation coil surrounding said core;
   - a movable assembly comprising a swingable ferromagnetic armature juxtaposed with an end of said core, and a leaf spring secured at an anchor point to said armature and having an end extending away from said anchor point to project beyond an end of said armature;
   - a coil return spring acting in tension on an opposite end of said armature in a sense tending to swing said armature into a position forming an air gap of maximum width between said core and said armature;
   - an exchange contact on said end of said leaf spring;
   - a closure contact juxtaposed with said exchange contact and engaged thereby upon energization of said coil drawing said armature toward said core, and an opening contact juxtaposed with said exchange contact and engaged thereby upon deenergization of said coil and swinging by said spring of said armature away from said core; and
   - an intermediate support element for said leaf spring formed by indenting a cavity in said armature to produce a bump thereon located substantially midway between said point and said exchange contact and in continuous contact with said leaf spring at least while said exchange contact is in engagement with said opening contact and during displacement of said armature toward said core, said intermediate support element being of such height and at such distance from said point that the leaf spring is under prestress prior to closure against said closure and opening contacts.

2. The relay defined i claim 1 further comprising a fixing element bearing upon said leaf spring over an entire width thereof for securing said leaf spring to said armature.

3. The relay defined in claim 2 wherein said fixing element is a fixing plate.

4. The relay defined in claim 3 wherein said leaf spring has a hole affording access of a measuring element to said armature.

* * * * *